US006290560B1

(12) United States Patent
Kidd et al.

(10) Patent No.: US 6,290,560 B1
(45) Date of Patent: Sep. 18, 2001

(54) FIN AND FIN SYSTEM

(76) Inventors: Guy Robert Kidd, 14 Chivalry Road, Glenfield, Auckland; Stuart Anthony Chilman, 5 Coblestone Lane, Hillcrest, Auckland, both of (NZ)

( * ) Notice: Subject to any disclaimer, the term of this patent is extended or adjusted under 35 U.S.C. 154(b) by 0 days.

(21) Appl. No.: 09/585,395

(22) Filed: Jun. 2, 2000

(30) Foreign Application Priority Data

May 29, 2000 (NL) ..... 504797

(51) Int. Cl.[7] ..... A63B 31/08
(52) U.S. Cl. ..... 441/64
(58) Field of Search ..... 441/61–64; D21/239, D21/806

(56) References Cited

U.S. PATENT DOCUMENTS 5,324,219 * 6/1994 Beltrani et al. ..... 441/64

* cited by examiner

*Primary Examiner*—Ed Swinehart
(74) *Attorney, Agent, or Firm*—Young & Thompson

(57) ABSTRACT

A diving fin and fin system for use with diving boots having a simplified attachment and quick release means wherein the diver can step in and out of the fins without having to stoop or bend. The principal advantage of this invention being its hands free operation and safety aspect.

10 Claims, 4 Drawing Sheets

FIN AND FIN SYSTEM

FIELD OF THE INVENTION

This invention relates to self contained underwater breathing apparatus (scuba) diving apparatus, in particular, but not exclusively to a quick release diving fin and fin system.

BACKGROUND ART

Fins used for scuba diving and snorkelling are well known. In particular, fins used in these activities have improved primarily in their design to reduce drag through water. The method of attaching fins to the feet of the diver or snorkeller, however, has not advanced to the same extent and such fins are still secured to the diver's feet by means of adjustable heel straps. Furthermore, divers now often wear diving boots of soft rubber over which their fins are worn. The difficulty of attaching and removing conventional fins on a pitching boat or diving platform presents a moderate difficulty which is further compounded if the diver is of a mature age or suffers from flexibility problems or has a bad back. Stooping or bending to release the heel straps of fins when also holding breathing apparatus or potentially hazardous implements such as spear guns can be particularly dangerous especially on a rocking boat. There is therefore a need for a fin design and a fin system for use with diving boots having a simplified attachment and quick release operation.

OBJECT OF THE INVENTION

It is an object of the invention to provide a diving fin for use with diving boots which alleviates at least one of the problems associated with wearing fins or to at least provide the public with a useful choice.

STATEMENT OF THE INVENTION

In one aspect, the invention resides in an improved fin for use with diving boots including in combination a fin member having diving boot quick release means adapted to engage and disengage a diving boot; the quick release means comprising a heel engaging clip biased to clip in secure locking arrangement, the heel of the boot and to unclip from the heel on application of moderate force against the bias.

In another aspect, the invention resides in a diving boot quick release attachment means adapted to be fitted to a conventional diving fin; the attachment means including in combination a support member adapted to be fastened to a foot pocket portion of the fin; the support member adapted to support diving boot quick release means adapted to engage and disengage a diving boot; the quick release means comprising a heel engaging clip biased to clip in secure locking arrangement, the heel of the boot and to unclip from the heel on application of moderate force against the bias.

In a further aspect, the invention resides in a specially adapted diving boot to be used with a fin having quick release diving boot engaging means adapted to engage and disengage the boot, the quick release means comprising a heel engaging clip biased to clip in secure locking arrangement, the heel of the boot; the heel having a complementary shaped portion adapted to engage with the clip and to disengage from the clip on application of moderate force against the bias.

In an alternative version, the invention resides in a separate heel retention fitting adapted to clip in secure locking arrangement, with a heel engaging clip; the fitting adapted to be attached to the heel section of a conventional diving boot.

Preferably the heel engaging clip is a wide hook shaped catch of resilient material such as an polypropylene, plastic or rubber, or similar material, biased to clip or hook onto the heel of a diving boot with a moderate force.

Preferably the diving boot has a shaped heel or a heel with a complementary shaped portion adapted to engage the heel engaging clip in a clip locking action.

Conveniently, disengagement of the diving boot from the fin is by application of moderate force against the bias of the clip to unlock the clip from the heel or portion of the heel of the boot adapted to engage the clip by hand, or by means of a suitable implement or by stepping on the clip with the other foot.

BRIEF DESCRIPTION OF THE DRAWINGS

In order that the present invention be more fully understood and put into practical effect, reference wile made to the accompanying drawings wherein.

DETAILED DESCRIPTION OF THE DRAWINGS

Example 1

Figure 1:
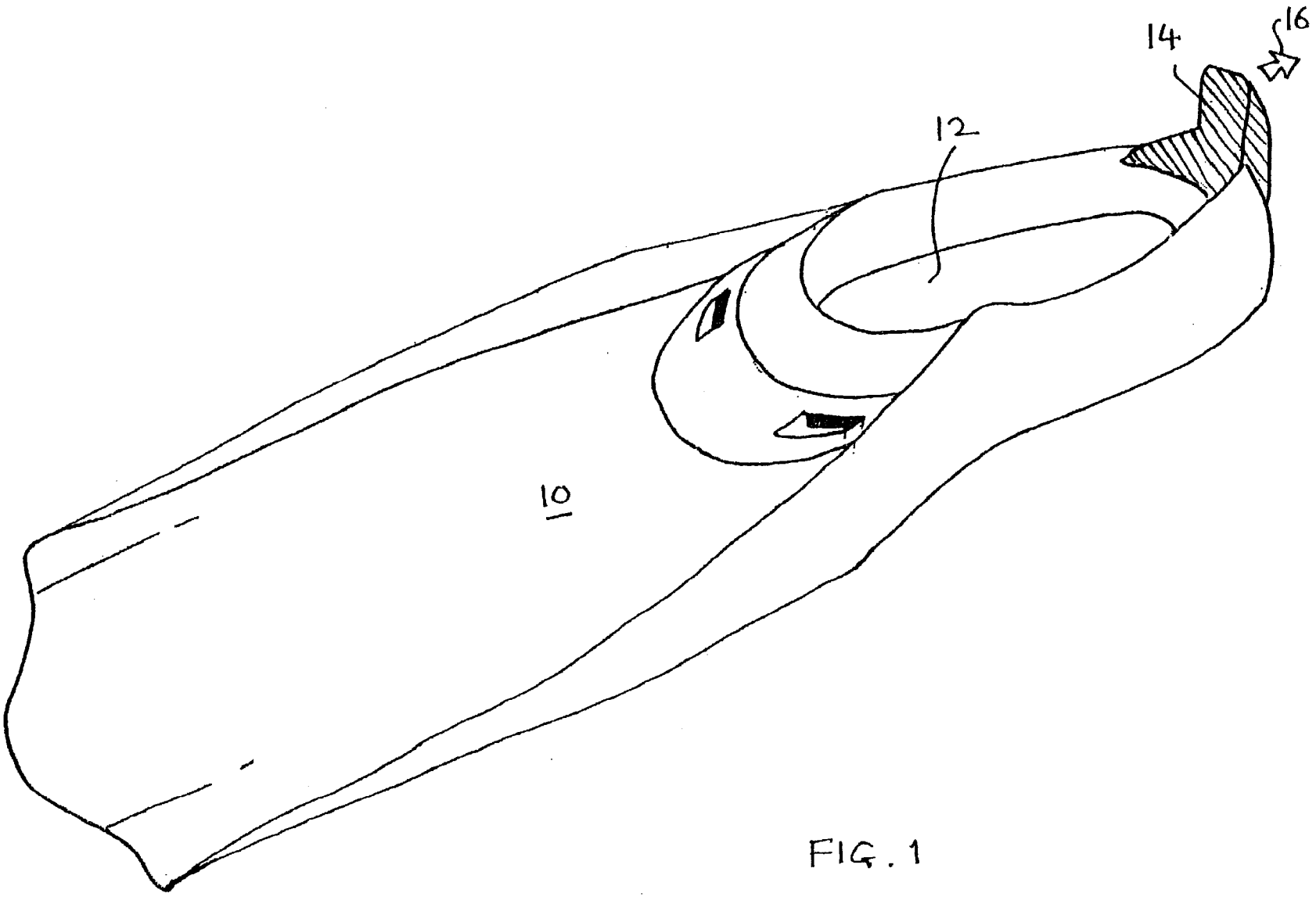
FIG. 1: shows a perspective view of a preferred embodiment of the invention according to Example 1.

Referring now to FIG. 1 there is shown a preferred fin according to Example 1 of the invention. The fin 10 is of a conventional design with a foot pocket 12 and has a preferred heel engagement clip 14 in the form of a wide hook shaped catch. A heel of a diving boot (not shown) is engaged by the catch. As the diver steps into the fin, the catch is forced away from the heel and when the boot is located in position in the foot pocket, the catch springs back to hook onto the heel in a clip locking action. To step out of the fin, a moderate force is applied in the direction of arrow 16 which unhooks or unlocks the catch from the heel of the boot thereby enabling the diver to step out of the fin. It is envisaged that unlocking or unhooking the hook shaped catch can be achieved with practice by stepping on the catch with the other foot thereby eliminating the need to stoop or bend to unhook each fin.

Example 2

Figure 2:
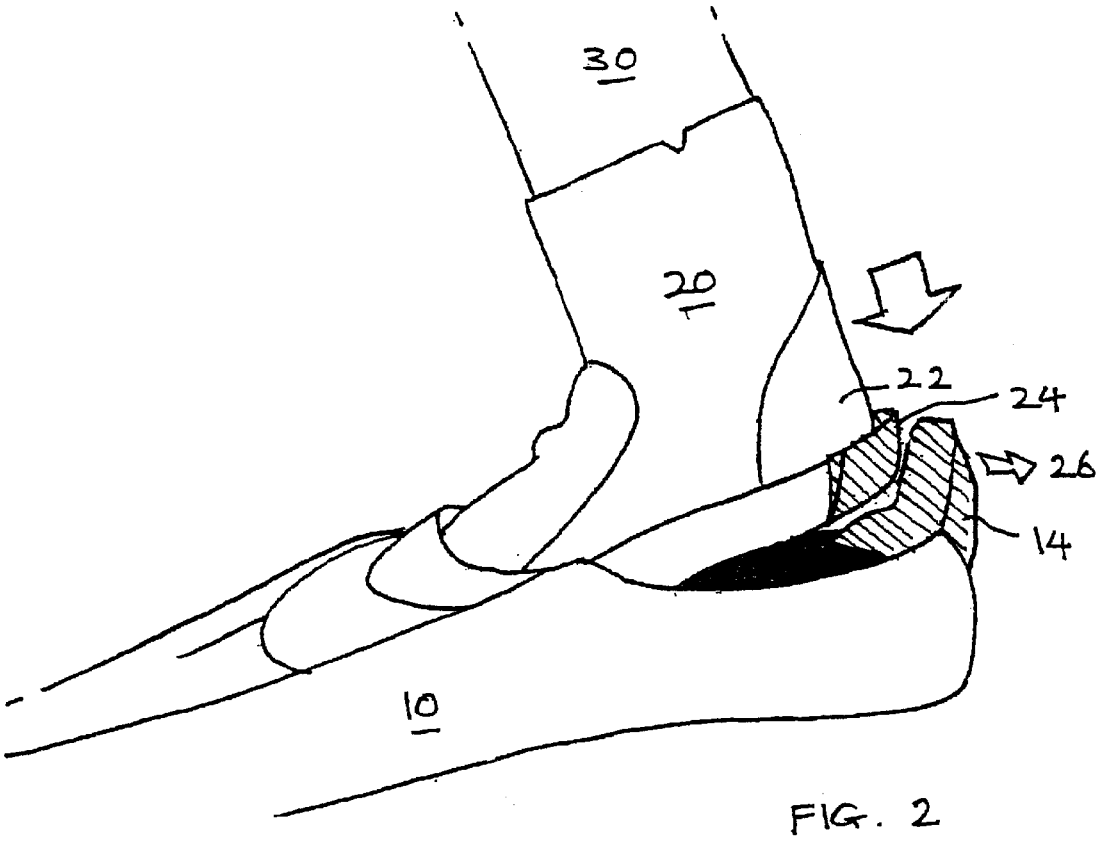
FIGS. 2, 2*a* and 2*b:* show drawings of the invention in operation according to Example 2.

FIG. 2 shows the fin 10 of FIG. 1 in use with a specially adapted diving boot 20 having a heel 22 with a shaped portion 24 according to Example 2. The diver 30 steps into the fin which forces away the heel engaging clip 14 or catch 14 in the direction of arrow 26. As the boot is seated in position in the fin, the catch engages the complementary shaped portion 24 to lock the boot into the fin shown in FIG. 2*a*.

Figure 2A:
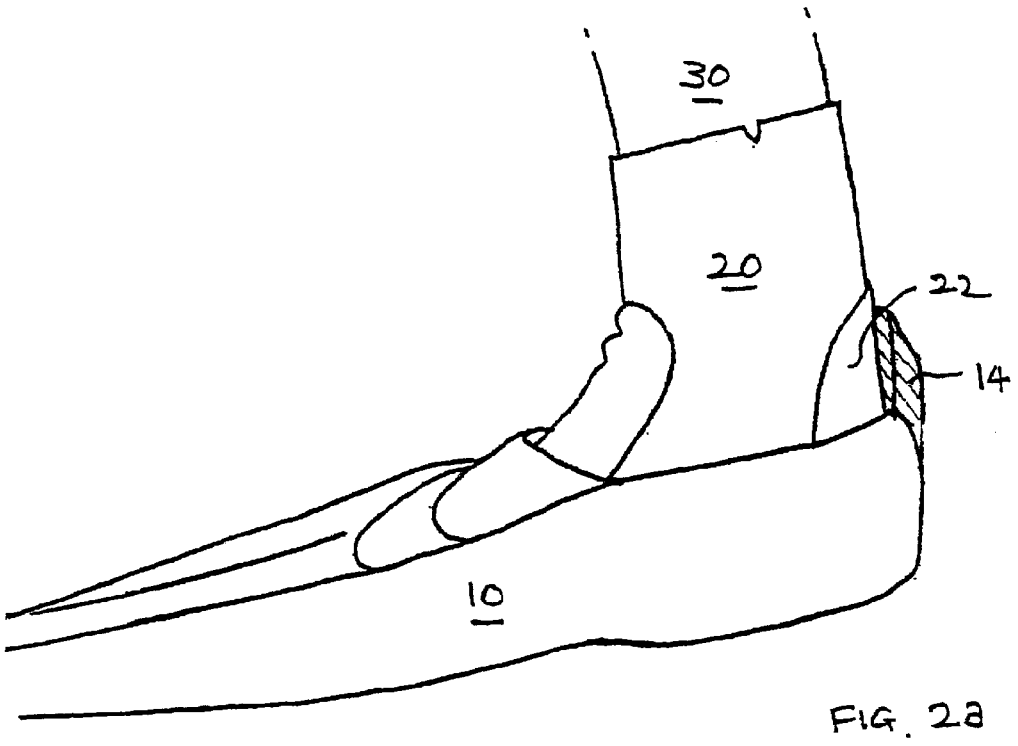
Figure 2B:
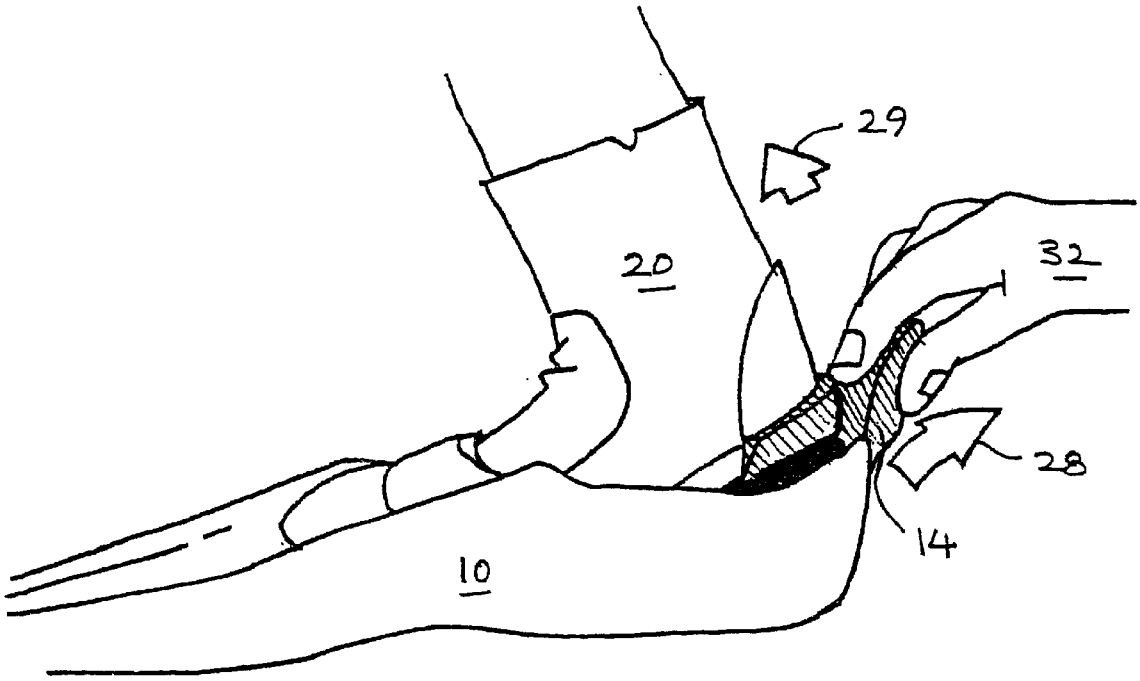

FIG. 2*b* shows the action of unlocking or unhooking the boot 20 of FIGS. 2 and 2*a* from the fin 10. A moderate force is applied to the heel engaging clip 14 in the direction of arrow 28 shown here by hand 32 which unclips the shaped portion 24 of the heel 22 from the heel engaging catch 14 thereby enabling the boot to be released from the fin in the direction of arrow 29.

Example 3

Figure 3:
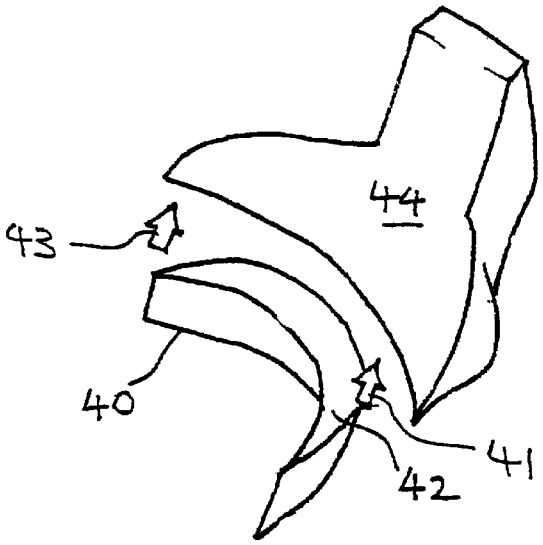
FIG. 3: shows another embodiment of invention according to Example 3.

FIG. 3 shows a separate fitting 40 adapted to be fitted to a conventional diving boot (not shown) to Example 3. The fitting is adapted to be glued or bonded to the rear or back of the diving boot (not shown) and has a complementary shaped portion 42 to that of the heel engaging clip 44 to ensure a positive clip locking engagement in the direction of arrows 41 and 43.

Example 4

Figure 4:
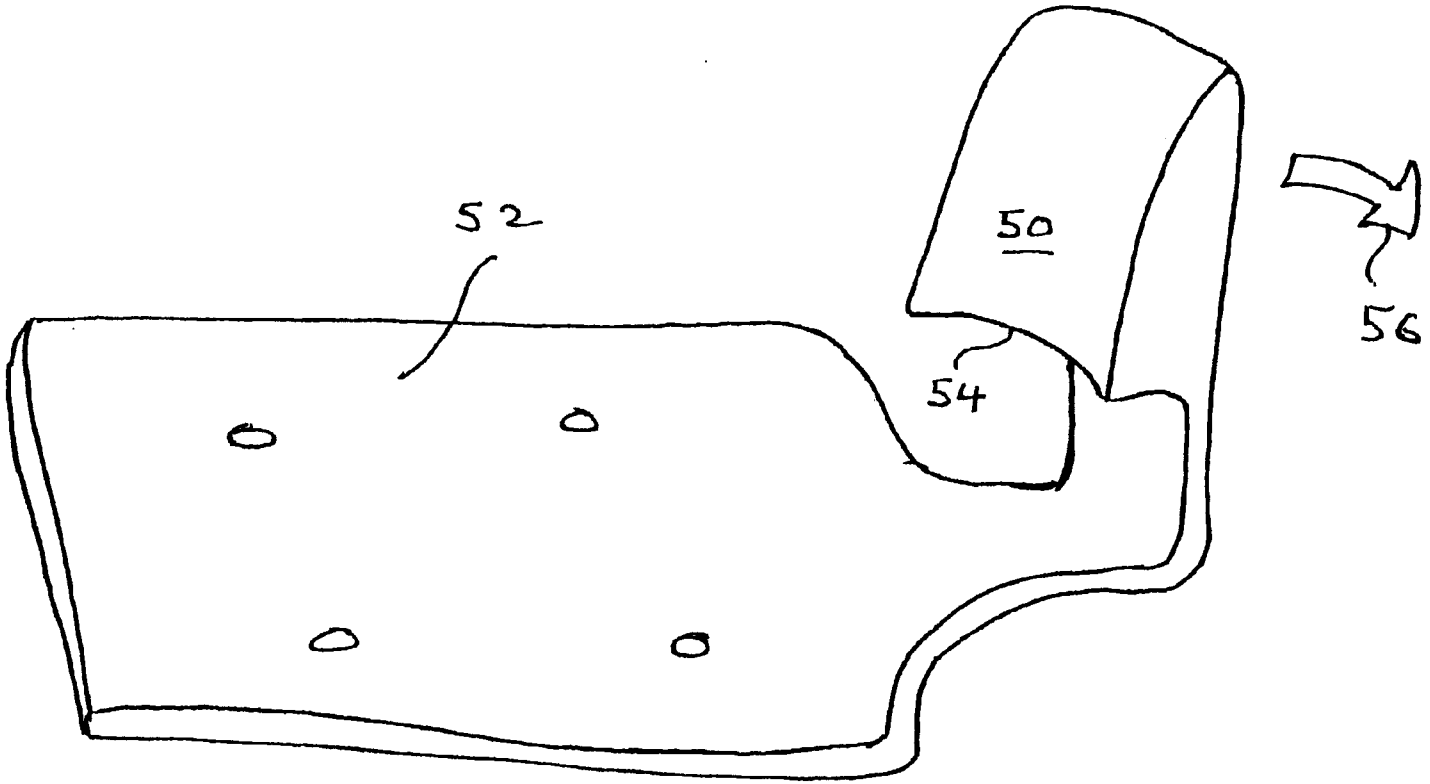
FIG. 4: shows a further embodiment of the invention according to Example 4.

FIG. 4 shows a preferred quick release boot attachment means 50 for attaching to a conventional fin (not shown) according to Example 4. The quick release attachment means comprises a plate member 52 which is attached by screws or rivets to the foot pocket of a fin (not shown). The plate member supports a heel engaging catch 54 which is designed to engage the heel of a specially adapted diving boot (not shown). The heel engaging catch can also be used with a conventional diving boot having a heel with a separate fitting as previously described for Example 3. The release of the fin from the diving boot is by a similar action as described for FIG. 1 and FIG. 2*b* wherein a moderate force applied to the heel engaging member in the direction of arrow 56 allows a diver to disengage the boot from the fin.

ADVANTAGES

The device is part of a swim fin primarily used for scuba diving, the device is made as part of a swim fin, with the possibility of retro fitting the device to existing fins. As part of a swim fin, the device is located at the rear of the fin, in the region of the heel; the device is used to retain a diving boot worn by the user in a manner that will not allow the boot to release without the aid of the user, but will facilitate the application of the fin to the foot or boot by merely stepping into the fin in a fashion not dissimilar to the stepping in and out of bindings of snow skis.

The benefits of this device are many and are directed to the user having to bend down to put the fin on (ie. of existing fins) which on its own is a difficult task especially with heavy dive gear worn on the back and the constrictions of a wet suit. Many divers also launch themselves from moving boats or into the surge at a beach which makes the putting on of fins quite difficult. The step in fin, subject of the present invention, requires that you simply drop the fin on the ground and without having to bend down, step into the fin wherein it will be retained by a clip lock action.

On removing the fin you simply flick the rear heel clip with your finger and at the same time lift the heel of the boot which is then released.

A specially designed boot fitting is also provided to aid the retention of the rear of the boot in the fin. This can be an aftermarket accessory or the heels of diving boots can be specially moulded to include a portion with the requisite shape.

Other benefits include the ease of manufacturing the fin because it can be a moulded in one piece. With no rear heel strap, no plastic clips or clip posts either side of the fin to retain the foot the stream lined nature of the fin is thus improved in an aesthetic and practical way.

It is envisaged that the device would be manufactured of the same materials as presently used in fin manufacture (e.g. polypropylene, plastics or rubber) and made in the various sizes that would normally be available in shoes.

The second aspect of the invention is to upgrade fins presently in use by the attachment of the fin device to an existing fin, i.e. by removing the straps and buckles and clip posts from an existing fin and mounting the device by glue and rivets and/or screws to the rear of the fin thereby converting the existing fin to the same simplified attachment and quick release operation.

VARIATIONS

Finally it will be appreciated that various other alterations and modifications may be made to the foregoing without departing from the scope of this invention as herein set forth in the claims.

Throughout the description and claims of this specification the word "comprise" and variations of that word, such as "comprises" and "comprising", are not intended to exclude other additives, components, integers or steps. The word "fin" is also interchangeable with the word "flipper".

What is claimed is:

1. A diving fin/diving boot engagement system comprising in combination:

an arcuate boot fitting that is separate from a diving boot, said boot fitting having a curved interior surface that engages an exterior surface of a heel of a diving boot and a projection on an exterior surface opposite said curved interior surface; and a fin fitting that is separate from a diving fin, said fin fitting comprising a plate that attaches to an interior sole of a shoe portion of a diving fin, a vertical member that is attached to said plate and extends generally perpendicular from said plate at a heel thereof, and a catch generally perpendicular to said vertical member and extending over said plate to define a plate-facing surface corresponding to said projection of said boot fitting, said plate-facing surface engaging said projection to hold the diving boot in the shoe portion of the diving fin when said boot fitting is attached to the diving boot and said fin fitting is attached to the diving fin.

2. A heel engaging clip adapted to be fitted to an existent diving fin, the clip comprising a base member being adapted to be fastened to a foot pocket of the fin, to support a quick release mechanism, and to engage and disengage a heel of an existent diving boot, the mechanism being adapted to be biased to clip onto and lock with the heel to secure the boot in a foot pocket of the fin, and adapted to unclip from the heel on the application of a moderate force against the bias to allow removal of the boot from the fin.

3. A heel engaging clip as claimed in claim 2 which is a wide hook shaped catch of resilient material biased to clip or hook onto the heel of a diving boot with moderate force.

4. A heel engaging clip as claimed in claim 3 wherein the resilent material for the hook shaped catch is one of polypropylene, plastic, and rubber.

5. A heel engaging clip as claimed in claim 3 wherein the disengagement of a diving boot from a fin is by application of moderate force against the bias of the clip to unlock the clip from the heel or portion of the heel of the boot adapted to engage the clip by hand.

6. A heel engaging clip as claimed in claim 3 wherein the disengagement of a diving boot from a fin is by application of moderate force against the bias of the clip to unlock the clip from the heel or portion of the heel of the boot adapted to engage the clip by stepping on the clip with the other foot.

7. A heel engaging clip as claimed in claim 4 wherein the disengagement of a diving boot from a fin is by application of moderate force against the bias of the clip to unlock the clip from the heel or portion of the heel of the boot adapted to engage the clip by hand.

8. A heel engaging clip as claimed in claim 4 wherein the disengagement of a diving boot from a fin is by application of moderate force against the bias of the clip to unlock the clip from the heel or portion of the heel of the boot adapted to engage the clip by stepping on the clip with the other foot.

9. A heel piece for attaching to an existent diving boot and having a complimentary shape to engage the heel engaging clip as claimed in claim 2.

10. A diving boot having a heel with a complimentary shape to engage the heel engaging clip as claimed in claim 2.

* * * * *